US011696076B2

(12) United States Patent
Takumai

(10) Patent No.: US 11,696,076 B2
(45) **Date of Patent: *Jul. 4, 2023**

(54) CONTENT OUTPUT DEVICE, AUDIO SYSTEM, AND CONTENT OUTPUT METHOD

(71) Applicant: Yamaha Corporation, Hamamatsu (JP)

(72) Inventor: Susumu Takumai, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/308,132

(22) Filed: May 5, 2021

(65) Prior Publication Data

US 2021/0258691 A1 Aug. 19, 2021

Related U.S. Application Data

(63) Continuation of application No. 16/576,884, filed on Sep. 20, 2019, now Pat. No. 11,032,645, which is a continuation of application No. PCT/JP2017/011719, filed on Mar. 23, 2017.

(51) Int. Cl.

| | |
|---|---|
| ***H04R 5/04*** | (2006.01) |
| ***H04R 5/02*** | (2006.01) |
| ***H04S 3/00*** | (2006.01) |

(52) U.S. Cl.

CPC ..... *H04R 5/04* (2013.01); *H04R 5/02* (2013.01); *H04S 3/008* (2013.01); *H04R 2420/05* (2013.01); *H04R 2420/07* (2013.01); *H04S 2400/01* (2013.01)

(58) Field of Classification Search

None

See application file for complete search history.

(56) References Cited

U.S. PATENT DOCUMENTS

| | | | | |
|---|---|---|---|---|
| 11,032,645 | B2 * | 6/2021 | Takumai | H04R 5/04 |
| 2005/0135643 | A1 | 6/2005 | Lee et al. | |

FOREIGN PATENT DOCUMENTS

| | | | |
|---|---|---|---|
| JP | 2003-134591 | A | 5/2003 |
| JP | 2005-184837 | A | 7/2005 |
| JP | 2006-129147 | A | 5/2006 |
| WO | WO 2008/126161 | A1 | 10/2008 |

OTHER PUBLICATIONS

International Search Report (PCT/ISA/210) issued in PCT Application No. PCT/JP2017/011719 dated Jun. 13, 2017 with English translation (two (2) pages).

(Continued)

*Primary Examiner* — Mark Fischer

(74) *Attorney, Agent, or Firm* — Crowell & Moring LLP

(57) ABSTRACT

A content output device includes at least one processor and at least one communicator. The at least one communicator is configured to output a plurality of channels from the at least one processor to a plurality of audio devices signals. When the number of audio devices increases and at least one additional channel is available to be reproduced, the assigning task assigns the at least one additional channel to the increased number of audio devices and the outputting task outputs the at least one additional channel in accordance with the changed assignment of the plurality of channels.

14 Claims, 10 Drawing Sheets

(56) References Cited

OTHER PUBLICATIONS

Japanese-language Written Opinion (PCT/ISA/237) issued in PCT Application No. PCT/JP2017/011719 dated Jun. 13, 2017 (four (4) pages).
Japanese-language Office Action issued in Japanese Application No. 2019-506831 dated Oct. 20, 2020 with English translation (six (6) pages).
English machine translation of JP 2003-134591 A (Takahashi, Iaso; Audio System; published May 2003) (Year: 2003.
English machine translation of JP 2006-129147 A (Nitta, Naoki; Multi-Channel Speaker System; published May 2006) (Year : 2006).
Ando, Akio; Conversion of Multichannel Sound Signal Maintaining Physical Properties of Sound in Reproduced Sound Field; IEEE Transactions on Audio, Speech, and Language Processing, vol. 19, No. 6, Aug. 2011; pp. 1467-1475 (Year: 2011).
Japanese-language Office Action issued in Japanese Application No. 2021-142178 dated Sep. 14, 2022 with English translation (eight (8) pages).

* cited by examiner

FIG. 4

| AUDIO DEVICE | IP ADDRESS | MAC ADDRESS | CHANNEL |
|---|---|---|---|
| SPEAKER11 | 192.168.0.11 | A1 : B1 : D1:1F:11:B1 | C |
| SPEAKER12 | 192.168.0.12 | A1 : B1 : D1:1F:11:B2 | FR |
| SPEAKER13 | 192.168.0.13 | A1 : B1 : D1:1F:11:B3 | SR |
| SPEAKER14 | 192.168.0.14 | A1 : B1 : D1:1F:11:B4 | SL |
| SPEAKER15 | 192.168.0.15 | A1 : B1 : D1:1F:11:B5 | FL |

CONTENT OUTPUT DEVICE, AUDIO SYSTEM, AND CONTENT OUTPUT METHOD

CROSS REFERENCE TO RELATED APPLICATIONS

The present application is a continuation of U.S. application Ser. No. 16/576,884, filed Sep. 20, 2019, which is a continuation of International Application No. PCT/JP2017/011719, filed on Mar. 23, 2017, the entire contents of which are incorporated herein by reference.

BACKGROUND

1. Technical Field

A preferred embodiment relates to a content output device, an audio system, and a content output method that output content of a plurality of channels.

2. Description of the Related Art

In recent years, in an audio system, as the number of channels of content is increased, the number of speakers has been increased.

Accordingly, International Publication No. 2008/126161 discloses a channel assigning device that automatically assigns a channel to a plurality of speakers.

The number of speakers may be increased and decreased according to a use state of a user. For example, a user may carry one speaker among a plurality of speakers used in a living room to a bedroom, and may use the speaker in the bedroom. In this manner, for example, when the number of speakers is reduced, sound of a channel that has been taken charge of by a speaker that has been reduced is not able to be reproduced. In the device disclosed in International Publication No. 2008/126161, a problem related to increase and decrease of the number of such speakers is not recognized.

SUMMARY

In view of the foregoing, an object of a preferred embodiment is to provide a content output device, an audio system, and a content output method that are capable of appropriately outputting sound of content even when the number of speakers is changed.

A content output device according to a preferred embodiment includes at least one processor configured to implement stored instructions and execute a plurality of tasks. The plurality of tasks include a connecting task, an outputting task, and an assigning task. The connecting task connects a plurality of audio devices. The outputting task outputs a content signal of a plurality of channels to the plurality of audio devices through the connecting task. The assigning task, when the number of the plurality of audio devices has been changed, assigns the plurality of channels to the plurality of audio devices, based on the number of audio devices that are connected at present, a channel to be outputted, and a channel corresponding to an audio device that has been changed.

According to a preferred embodiment, the sound of content is able to be appropriately outputted even when the number of speakers is changed.

The above and other elements, features, steps, characteristics and advantages will become more apparent from the following detailed description of the preferred embodiments with reference to the attached drawings.

BRIEF DESCRIPTION OF THE DRAWINGS

FIG. 4 is a view showing a correspondence between an audio device and channel information.

DETAILED DESCRIPTION OF THE PREFERRED EMBODIMENTS

Figure 1:
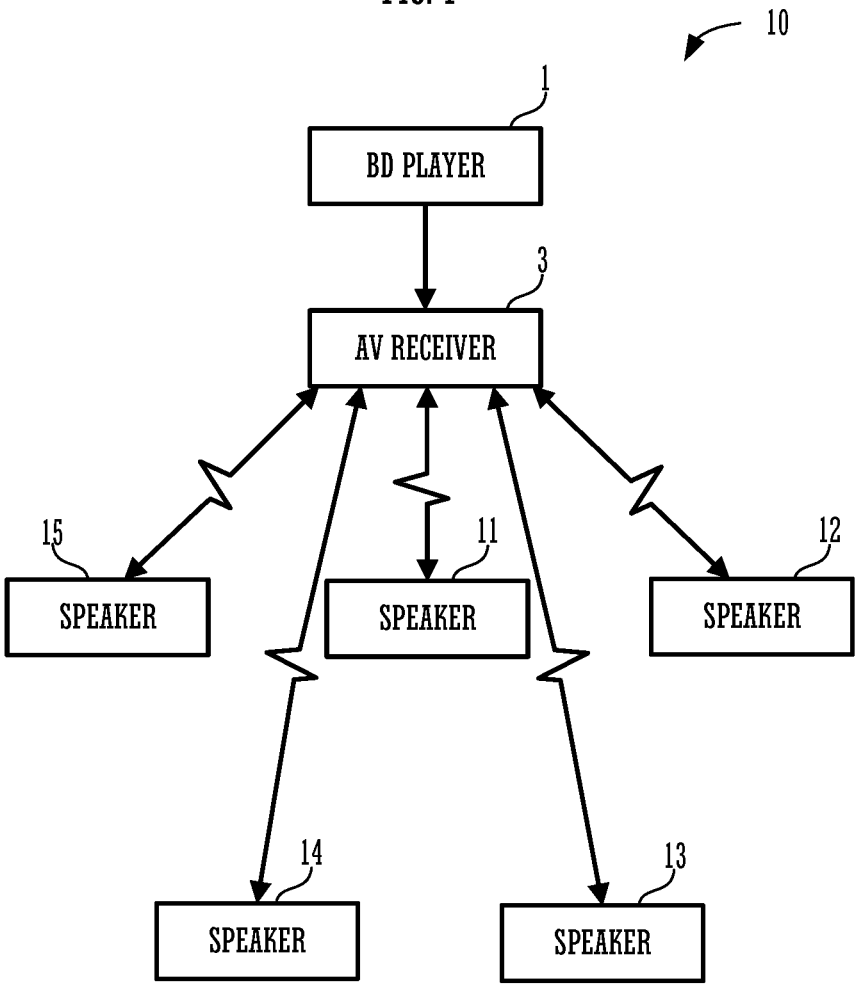
FIG. 1 is a conceptual diagram for illustrating a configuration of an audio system.
Figure 2:
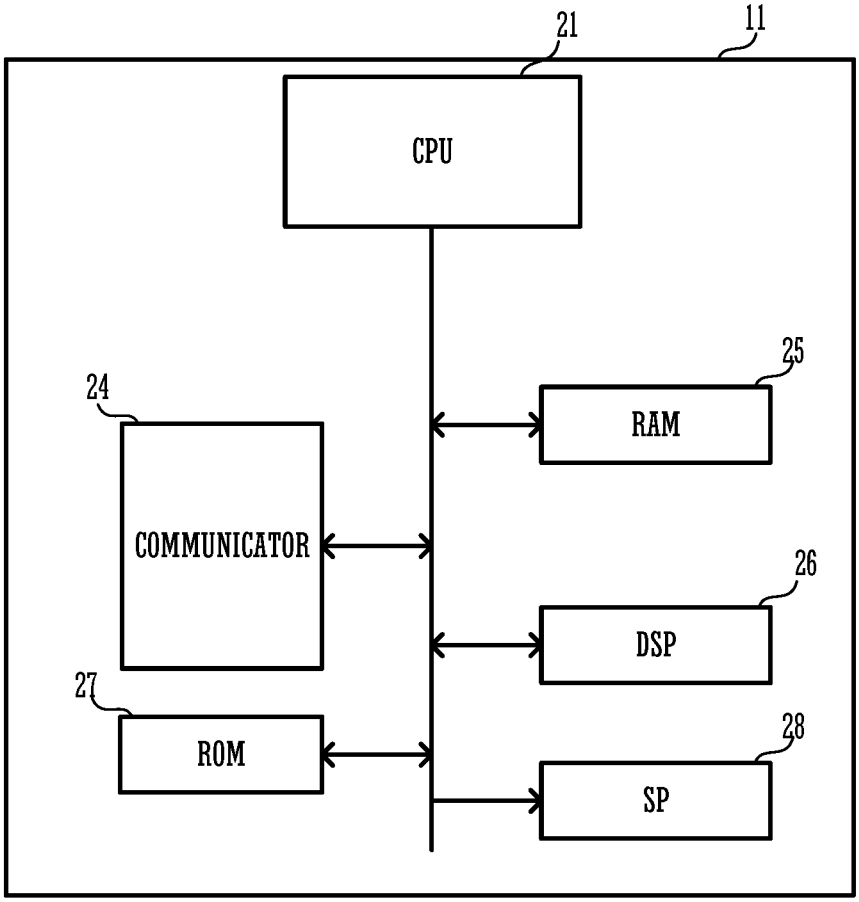
FIG. 2 is a block diagram showing a configuration of a wireless speaker.
Figure 3:
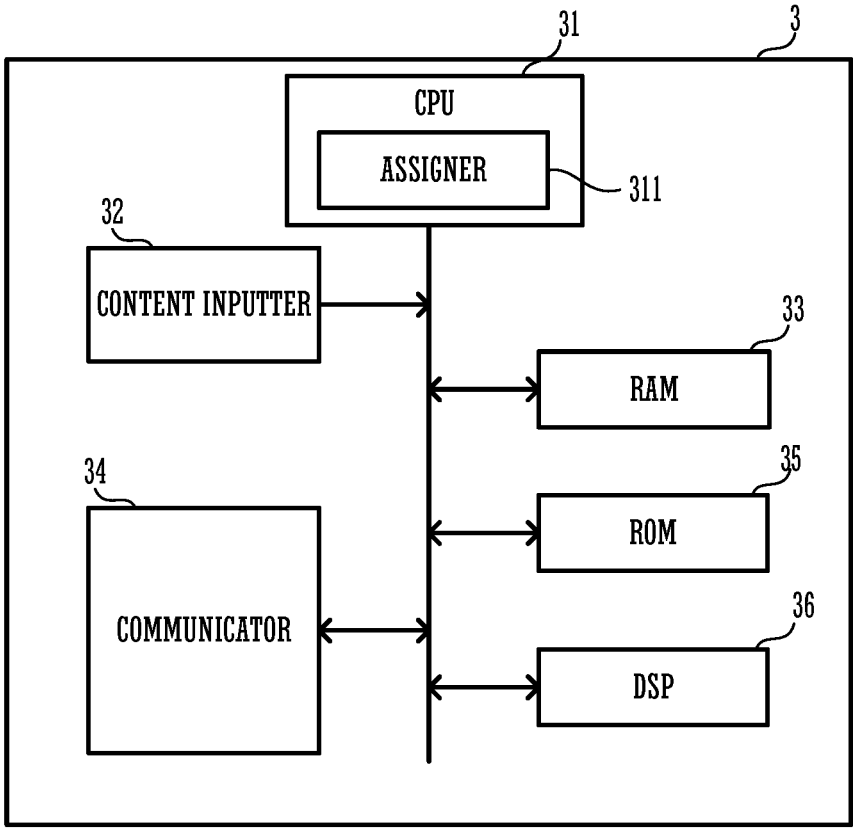
FIG. 3 is a block diagram showing a configuration of an AV receiver.

FIG. 1 is a conceptual diagram for illustrating a configuration of an audio system 10 according to a preferred embodiment of the present invention. FIG. 2 is a block diagram showing a configuration of a wireless speaker 11. FIG. 3 is a block diagram showing a configuration of an AV receiver 3.

As shown in FIG. 1, the audio system 10 includes a BD (Blu-ray Disc) player 1, an AV receiver 3, and a plurality of audio devices (a wireless speaker 11, a wireless speaker 12, a wireless speaker 13, a wireless speaker 14, and a wireless speaker 15).

The BD player 1 is a device that reproduces content. The BD player 1 transmits the reproduced content to the AV receiver 3. It is to be noted that the AV receiver 3 is not limited to an example of obtaining the content from the BD player 1, and may download content from a content server through the internet for example. It is to be noted that the BD player 1 and the AV receiver 3 may be connected by wire or may be connected by wireless. In addition, the AV receiver 3 may incorporate the function of the BD player 1.

The plurality of audio devices (the wireless speaker 11, the wireless speaker 12, the wireless speaker 13, the wireless speaker 14, and the wireless speaker 15) are respectively arranged in different positions. In this example, the wireless speaker 11 is arranged in the front of a listening position, the wireless speaker 12 is arranged in the right front of the listening position, the wireless speaker 13 is arranged in the right rear of the listening position, the wireless speaker 14 is arranged in the left rear of the listening position, and the wireless speaker 15 is arranged in the left front of the listening position.

The AV receiver 3 constructs a wireless LAN through a router with a wireless access point function, a router function of the own device, or the like. The AV receiver 3, through the wireless LAN, connects to the wireless speaker 11, the wireless speaker 12, the wireless speaker 13, the wireless speaker 14, and the wireless speaker 15. It is to be noted that the number of audio devices and the arrangement of the audio devices are able to be properly changed according to the use state of a user.

The AV receiver 3 corresponds to the content output device of the present invention. The AV receiver 3 outputs content of a plurality of channels. In the present preferred embodiment, examples of the content include multi-channel audio data. The content output device of the present invention may be a speaker provided with a CPU or a DSP, for example, other than the AV receiver 3. Alternatively, the content output device of the present invention is able to be achieved by an information processing apparatus such as a personal computer.

FIG. 2 is a block diagram showing a configuration of the wireless speaker 11. The wireless speaker 11, the wireless speaker 12, the wireless speaker 13, the wireless speaker 14, and the wireless speaker 15 have the same configuration and function. Therefore, in FIG. 2, the wireless speaker 11 will be described as an example.

The wireless speaker 11 includes a CPU 21, a communicator 24, a RAM 25, a DSP 26, a ROM 27, and a speaker 28.

The communicator 24 is a wireless communicator according to the Wi-Fi (a registered trademark) standard, for example. The communicator 24 communicates with the AV receiver 3 through a not-shown router with a wireless access point function. Alternatively, the communicator 24 directly communicates with the AV receiver 3.

The ROM 27 is a storage medium and stores a program for operating the CPU 21. The CPU 21, by reading the program stored in the ROM 27 to the RAM 25 and executing the program, performs various types of processing. For example, the CPU 21 inputs a signal of content received from the AV receiver 3 through the communicator 24, to the DSP 26. The DSP 26 performs various types of signal processing on an inputted signal. In addition, the DSP 26, in a case of having received encoded data as a signal of content, decodes the encoded data, and extracts an audio signal.

The CPU 21 inputs the signal that has been processed by the DSP 26, into the speaker 28. It is to be noted, although illustration is omitted, the speaker 28 includes a D/A converter that converts a digital audio signal into an analog audio signal, and an amplifier that amplifies an audio signal. The speaker 28 outputs sound on the basis of the inputted signal.

FIG. 3 is a block diagram showing a configuration of the AV receiver 3. The AV receiver 3 includes a CPU 31, a content inputter 32, a RAM 33, a communicator 34, a ROM 35, and a DSP 36.

The communicator 34 is a wireless communicator according to the Wi-Fi (a registered trademark) standard, for example. The communicator 34 communicates with the wireless speaker 11, the wireless speaker 12, the wireless speaker 13, the wireless speaker 14, and the wireless speaker 15 through a not-shown router with a wireless access point. Alternatively, the communicator 24 directly communicates with the wireless speaker 11, the wireless speaker 12, the wireless speaker 13, the wireless speaker 14, and the wireless speaker 15.

The ROM 35 is a storage medium and stores a program for operating the CPU 31. The CPU 31, by reading the program stored in the ROM 35 to the RAM 33 and executing the program, performs various types of processing.

For example, the CPU 31 inputs a signal of content inputted from the content inputter 32, to the DSP 36. The DSP 36 performs various types of signal processing on an inputted signal. In addition, the DSP 36, in a case of having received encoded data as a signal of content, decodes the encoded data, and extracts an audio signal.

The CPU 31 executes the program to achieve an assigner 311 of the present invention. In addition, the CPU 31 achieves a detector that detects that the number of speakers that are connected has been changed.

FIG. 4 is a table showing an example of channels of content assigned to the wireless speaker 11, the wireless speaker 12, the wireless speaker 13, the wireless speaker 14, and the wireless speaker 15 that are stored in a memory (the RAM 33 or the ROM 35) of the AV receiver 3.

The CPU 31 assigns a channel to each of the wireless speaker 11, the wireless speaker 12, the wireless speaker 13, the wireless speaker 14, and the wireless speaker 15. The assigner 311 of the CPU 31 has the function of assigning a channel.

As shown in FIG. 4, an IP address (a local IP address) is assigned to each of the wireless speaker 11, the wireless speaker 12, the wireless speaker 13, the wireless speaker 14, and the wireless speaker 15. Although the router assigns an IP address, the AV receiver 3 may assign the IP address. In a case in which the router assigns an IP address, the AV receiver 3 obtains information on the IP address from the router.

Each of the wireless speaker 11, the wireless speaker 12, the wireless speaker 13, the wireless speaker 14, and the wireless speaker 15 has a MAC address being individual identification information that is unique to each wireless speaker. It is to be noted that the individual identification information may be any other number as long as the number includes the individual identification information that is unique to a wireless speaker, such as a serial number or an ID number. The IP address and the MAC address are previously associated with each other, and are stored in the memory of the AV receiver 3. When the MAC address is stored in the AV receiver 3, in a case in which the wireless speaker (the wireless speaker 11, for example) has been once removed from a network and is then connected to the network again, the MAC address is received from the connected wireless speaker, so that the connected wireless speaker is identified, and the channel that has been assigned to the wireless speaker is able to be known. However, the MAC address is not an indispensable element in the present invention.

In this example, the assigner 311 assigns a C channel to the wireless speaker 11, an FR channel to the wireless speaker 12, an SR channel to the wireless speaker 13, an SL channel to the wireless speaker 14, and an FL channel to the wireless speaker 15.

For example, a user may operate the AV receiver 3 and sets instructions of these assignments. Alternatively, the user may set instructions of these assignments using an information processing apparatus such as a smartphone that is connected to the AV receiver 3 through the network.

The CPU 31 transmits a signal of the assigned channel to each of the wireless speaker 11, the wireless speaker 12, the wireless speaker 13, the wireless speaker 14, and the wireless speaker 15.

As a result, the content of the channel assigned to each wireless speaker is distributed. Each wireless speaker reproduces sound related to the content corresponding to the distributed channel.

The AV receiver 3, in a case in which the number of wireless speakers has been changed, assigns a channel to an audio device, based on the number of audio devices (the wireless speakers) that are connected at present, a channel to be outputted, and a channel corresponding to an audio device that has been changed.

Figure 5:
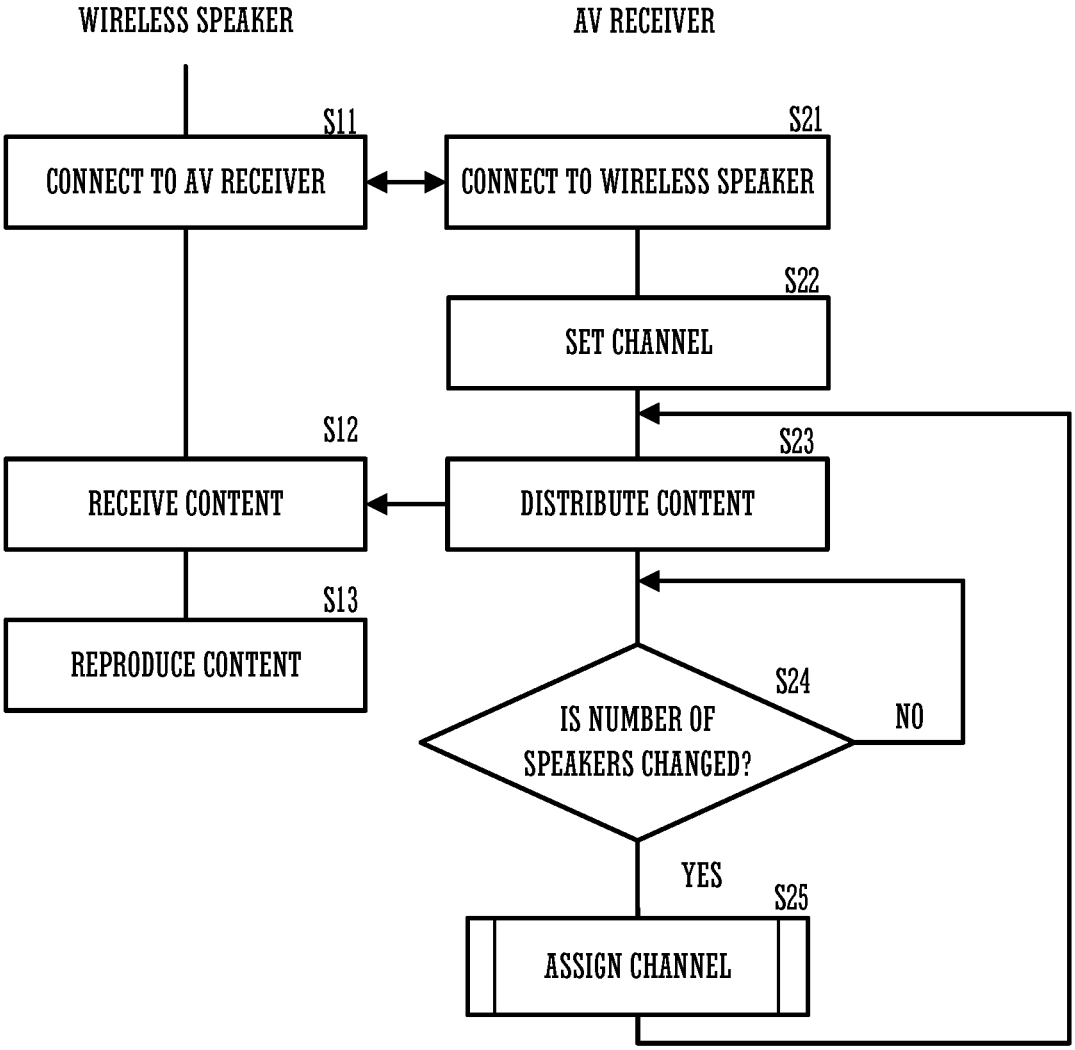
FIG. 5 is a flow chart showing an operation of the wireless speaker and the AV receiver.
Figure 6:
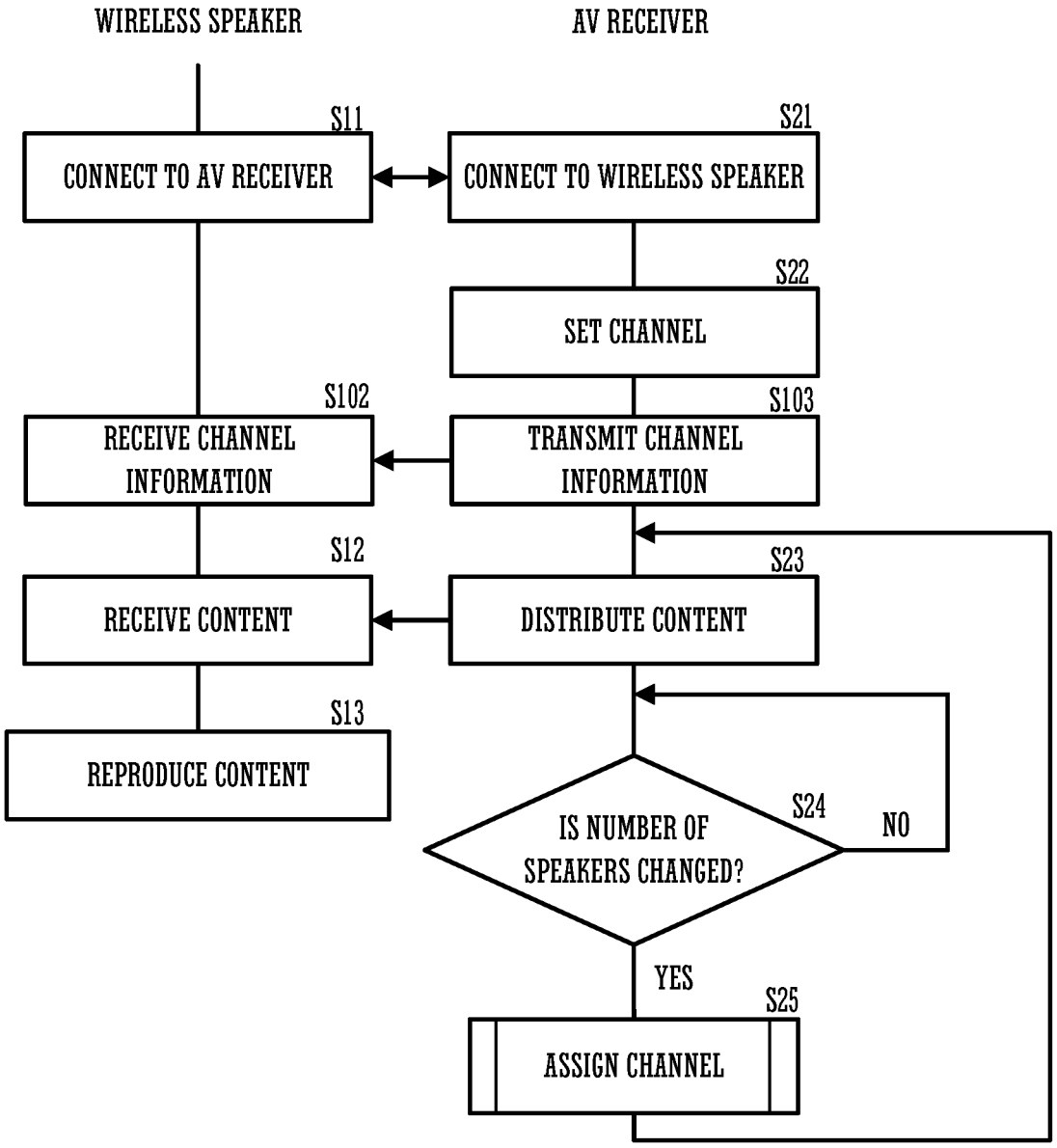
FIG. 6 is a flow chart showing an operation of a wireless speaker and an AV receiver according to a modification.
Figure 7:
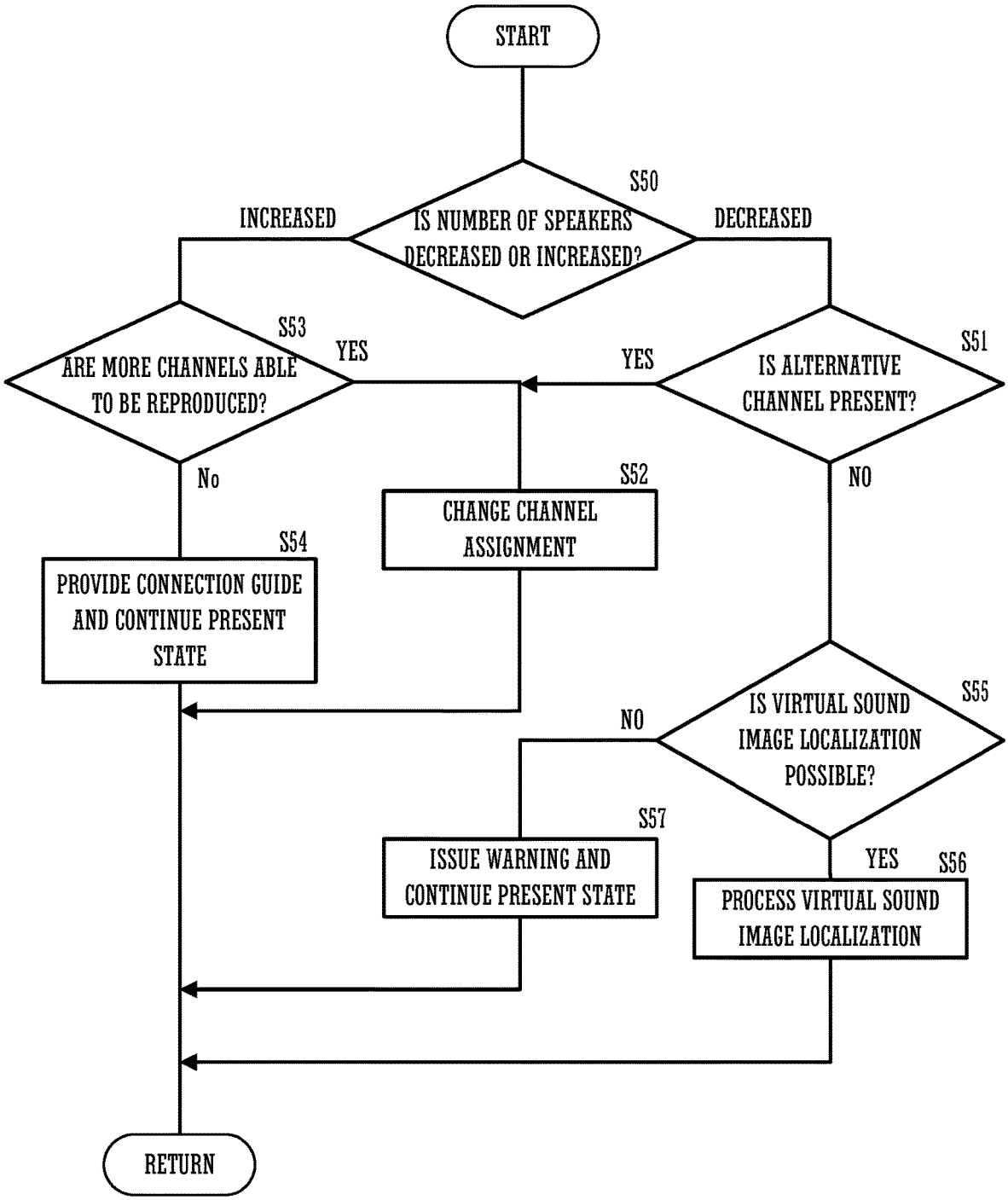
FIG. 7 is a flow chart showing an operation of the AV receiver.
Figure 8A:
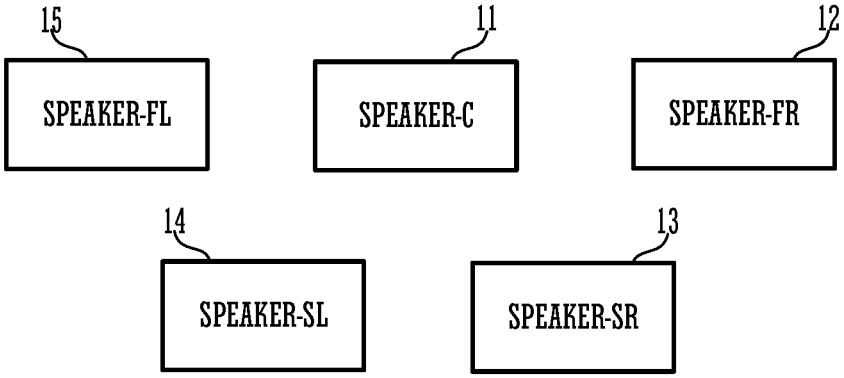
FIG. 8A is a view showing an aspect of channel assignment in a case in which the number of wireless speakers is changed, FIG. 8B, differently from FIG. 8A, is a view showing an aspect of channel assignment in a case in which the number of wireless speakers is changed, and FIG. 8C, differently from FIG. 8A and FIG. 8B, is a view showing an aspect of channel assignment in a case in which the number of wireless speakers is changed.
Figure 8B:
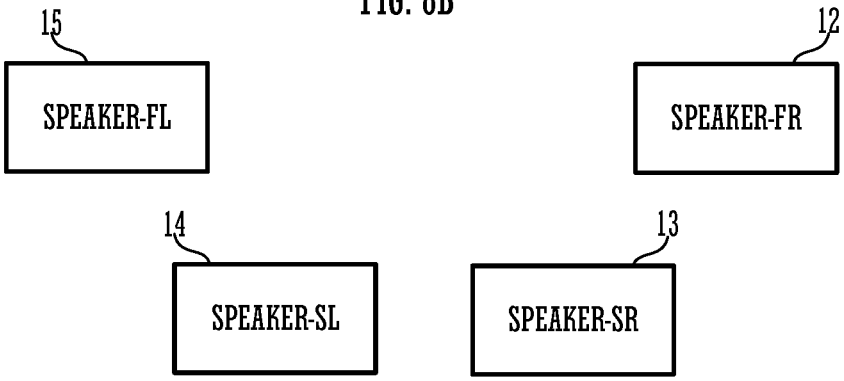
Figure 8C:
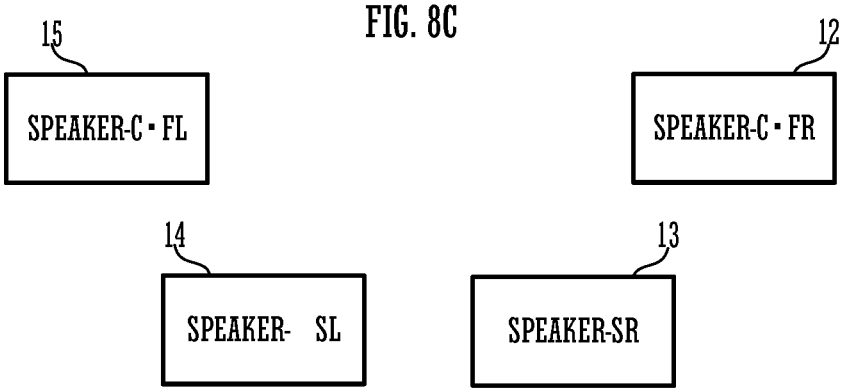

FIG. 5 and FIG. 6 are flow charts showing an operation of the wireless speaker and the AV receiver 3. FIG. 7 is a flow chart showing an assignment operation of the AV receiver 3. FIG. 8A, FIG. 8B, and FIG. 8C are each a view showing an aspect of channel assignment in a case in which the number of wireless speakers is changed.

First, each of the wireless speakers and the AV receiver 3 are connected to each other through the wireless LAN (S11, S21). The AV receiver 3, as shown in FIG. 4, assigns a channel to each wireless speaker that is connected (S22). The AV receiver 3 distributes content to each wireless speaker (S23).

Each wireless speaker receives content (S12) and reproduces the content (S13). For example, as shown in FIG. 8A, the wireless speaker 11 receives and reproduces the content of the C channel, the wireless speaker 12 receives and reproduces the content of the FR channel, the wireless speaker 13 receives and reproduces the content of the SR channel, the wireless speaker 14 receives and reproduces the content of the SL channel, and the wireless speaker 15 receives and reproduces the content of the FL channel. It is to be noted that, for example, as shown in FIG. 6, the AV receiver 3, after setting a channel in S22, may transmit channel information to the wireless speaker 11 (S103). In such a case, the wireless speaker 11 receives the channel information (S102). Then, the AV receiver 3, in S23, distributes the content of all the channels by broadcasting. The wireless speaker 11, based on content information received in S102, in S13, extracts and reproduces a corresponding channel.

The AV receiver 3, as a function of the detector, determines whether or not the number of speakers that are connected has been changed (S24). The AV receiver 3 is able to determine whether or not the number of speakers that are connected has been changed, by periodically checking connection with a wireless speaker, for example. Alternatively, the AV receiver 3, in a case of connecting with a wireless speaker through a router, is also able to determine whether or not the number of speakers that are connected has been changed, by receiving information (a list of IP addresses or the like, for example) on the devices that are connected at present, from the router. In addition, for example, the user may manually input information that the number of speakers has been changed, to the AV receiver 3.

The AV receiver 3, when the number of speakers has been changed, assigns a channel to an audio device, based on the number of audio devices that are connected at present, a channel to be outputted, and a channel corresponding to an audio device that has been changed (S25).

FIG. 7 is a detailed flow chart of an assigning operation in S25. First, the AV receiver 3 determines whether the number of speakers has been increased or decreased (S50). The AV receiver 3, in a case in which the number of speakers has been decreased, determines whether or not the channel of which a decreased speaker has been taken charge is able to be replaced with another speaker (S51). The AV receiver 3, in a case of having determined that an alternative is possible, changes channel assignment (S52).

For example, in the example of FIG. 8A, the channel to be outputted includes five channels of the C channel, the FL channel, the FR channel, the SL channel, and the SR channel. As shown in FIG. 8B, when the connection with the wireless speaker 11 is released, the number of wireless speakers that are connected at present becomes four, and the connection with the wireless speaker 11 associated with the C channel is interrupted. Then, the AV receiver 3, as shown in FIG. 8C, distributes the content of the C channel to the wireless speaker 12 and the wireless speaker 15. In other words, the AV receiver 3 also assigns the C channel in addition to the FR channel, to the wireless speaker 12. In addition, the AV receiver 3 also assigns the C channel in addition to the FL channel, to the wireless speaker 15.

As a result, the user does not need to manually reset assignment even when the configuration of the wireless speakers that are connected to the AV receiver 3 is changed. For example, in a case in which a problem occurs in a wireless speaker or even in a case in which some wireless speakers are not able to continue reproduction due to a network failure, the AV receiver 3 is able to reproduce the channel that is taken charge of by the wireless speaker of which the connection has been interrupted, by using remaining wireless speakers, and does not lack a specific channel.

In addition, in a case in which a speaker has high portability as with a wireless speaker, or in a case in which a user carries a wireless speaker to another room or other places and uses the speaker alone (in a case of using the speaker that is not connected to a network or in a case of making the speaker reproduce different content), the configuration of a wireless speaker may be frequently changed. For example, in a case in which a certain user watches movie content (content including an audio signal of five channels) in a living room, a family member of the user may take a wireless speaker that has been taken charge of the C channel. However, the AV receiver 3, by using the remaining wireless speakers, is able to reproduce the C channel and does not lack the C channel.

However, the audio device of the present invention is not limited to the wireless speaker. A wired speaker is also an example of the audio device of the present invention. Further, a receiver other than the AV receiver 3 or an information processing apparatus such as a smartphone is also an example of the audio device of the present invention.

In addition, the AV receiver 3, in a case of having determined that the number of speakers is increased in determination of S50 in FIG. 7, determines whether or not more channels are able to be reproduced (S53). The AV receiver 3, in a case of having determined that the more channels are able to be reproduced, changes channel assignment (S52). The AV receiver 3, for example, in a case of having assigned any one of the channels in the past to an increased speaker, is able to achieve reproduction of the more channels than at present by reassigning a channel to the speaker.

For example, a family member may bring the wireless speaker 11 back to the living room again from another room, and may connect the speaker to the AV receiver 3. The AV receiver 3, when being connected to the wireless speaker 11, reads out a correspondence table (see FIG. 4) stored in the memory. The AV receiver 3, according to the correspondence table, assigns the C channel to the wireless speaker 11, assigns the FR channel to the wireless speaker 12, and assigns the FL channel to the wireless speaker 15.

In this manner, the AV receiver 3 is able to reproduce the more channels by transmitting the content of the C channel that has been assigned in the past, to the wireless speaker 11. It is to be noted that the AV receiver 3 is able to identify connected wireless speakers by receiving a MAC address of each of the connected wireless speakers. In addition, the AV receiver 3 is able to determine the channel that has been assigned by reading out the correspondence table as shown in FIG. 4 in the past from a memory.

The AV receiver 3, in a case of having determined that the more channels are not able to be reproduced (for example, in a case in which unique identification information of a connected wireless speaker is not able to be obtained, or in a case in which a channel assigned in the past does not exist), provides a connection guide and continues the present state (S54). The AV receiver 3, as the connection guide, for example, on a display (not shown), displays an indication such that "please set a channel since a new speaker has been connected." Alternatively, the AV receiver 3 provides such a connection guide on the display by using a program executed in the information processing apparatus such as a smartphone.

It is to be noted that, in a case in which a channel of a speaker is previously set to a newly connected speaker or in a case in which a user sets a channel with a physical button provided in the speaker or sets a channel from the outside by using an application program of an information processing apparatus such as a smartphone or a similar case, it is also possible to set channel information to a speaker to be newly connected before being connected. In such a case, the AV receiver 3, in the processing of S53, may determine that the more channels are able to be reproduced, and may change channel assignment.

On the other hand, the AV receiver 3, in a case of having determined that the number of speakers is decreased and also having determined that no alternative channels are present in S51 in the determination of S50 in FIG. 7, determines whether or not sound of a decreased channel is able to be reproduced by virtual sound image localization processing (S55). The AV receiver 3, in a case of having determined that the virtual sound image localization processing, performs the virtual sound image localization processing (S56).

Figure 9A:
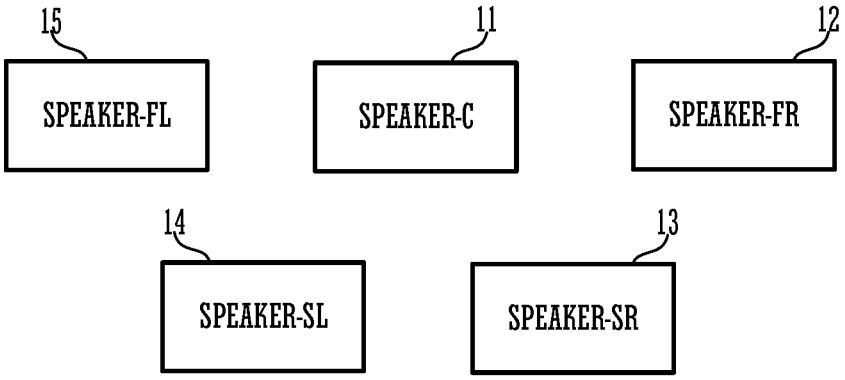
FIG. 9A is a view showing an aspect of channel assignment in a case in which the number of wireless speakers is changed, FIG. 9B, differently from FIG. 9A, is a view showing an aspect of channel assignment in a case in which the number of wireless speakers is changed, and FIG. 9C, differently from FIG. 9A and FIG. 9B, is a view showing an aspect of channel assignment in a case in which the number of wireless speakers is changed.
Figure 9B:
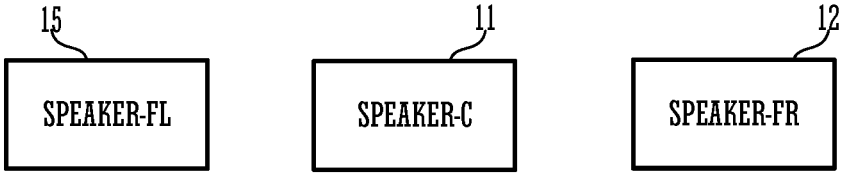

For example, in the example of FIG. 9A, the channel to be outputted includes five channels of the C channel, the FL channel, the FR channel, the SL channel, and the SR channel. As shown in FIG. 9B, when the connection of the wireless speaker 13 and the wireless speaker 14 is released, the number of wireless speakers connected at present becomes three. The AV receiver 3 determines that alternative reproduction is impossible since all the three wireless speakers connected at present are speakers to be installed on the front side. Then, the AV receiver 3, by using the wireless speaker 15 of the FL channel and the wireless speaker 12 of the FR channel, determines that the virtual sound image localization of the SL channel and the SR channel is possible, and performs the virtual sound image localization processing.

Figure 9C:
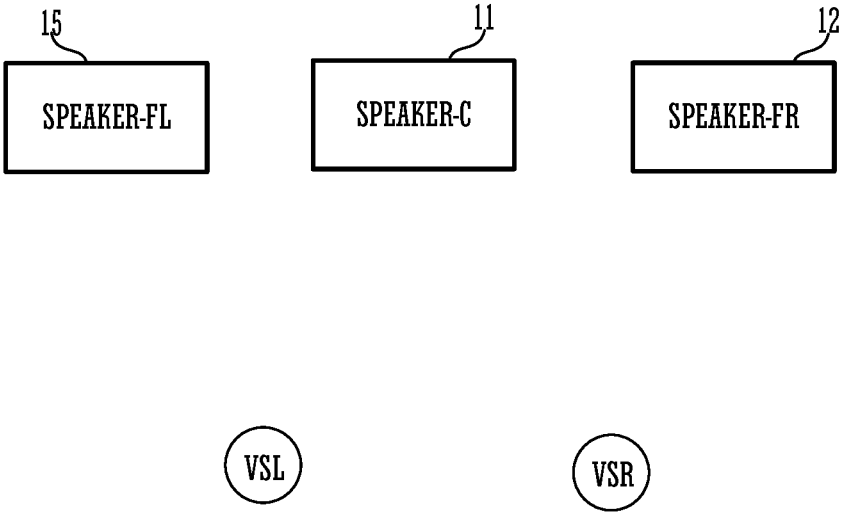

The virtual sound image localization uses a head-related transfer function (hereinafter referred to as HRTF) that indicates a transfer function between a sound source position and an ear of a listener. The HRTF corresponds to an impulse response that expresses the loudness, arrival time, frequency characteristics, and the like of a sound emitted from a virtual speaker installed in a certain position to right and left ears of the listener. The AV receiver 3 adds an audio signal of the SR channel and the SL channel to an audio signal of the FR channel and the FL channel. Then, the AV receiver 3 applies the HRTF from each sound source position to the right and left ears of the listener to the audio signal of the SR channel and the SL channel. As a result, as shown in FIG. 9C, the content of the SR channel and the SL channel is able to be localized in a virtual sound image.

On the other hand, the AV receiver 3, in the determination of S55 in FIG. 7, in a case of having determined that the virtual sound image localization processing is also impossible due to a case in which an HRTF to be applied is not prepared or similar cases, issues an warning and continues the present state (S57). For example, the AV receiver 3 displays an indication such that "a specific channel is unable to be reproduced" on a display (not shown). Alternatively, the AV receiver 3 may issue such a warning by using a program executed in the information processing apparatus such as a smartphone.

Figure 10A:
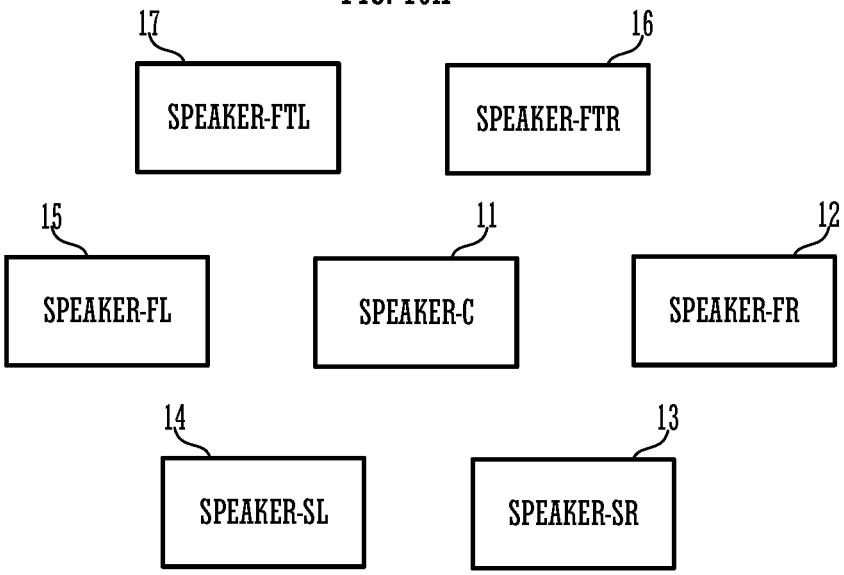
FIG. 10A is a view showing an aspect of channel assignment in a case in which the number of wireless speakers is increased, and FIG. 10B, differently from FIG. 10A, is a view showing an aspect of channel assignment in a case in which the number of wireless speakers is increased.
Figure 10B:
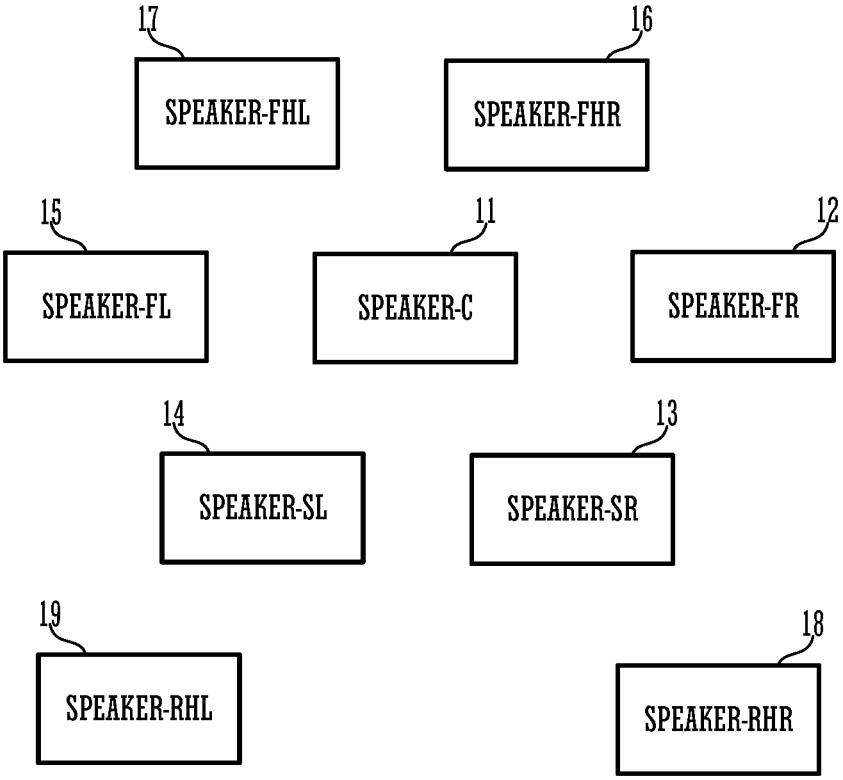

It is to be noted that the AV receiver 3, in a case in which the number of speakers is increased as shown in FIG. 10A and FIG. 10B, may reassign the channel that has been assigned to the previous audio device to another channel.

For example, the AV receiver 3, in a case of being connected to a wireless speaker 16 of a front top R (FTR) channel and a wireless speaker 17 of a front top L (FTL) channel as shown in FIG. 10A and then being newly connected to two wireless speakers 18 and 19 as shown in FIG. 10B, may reassign the channel that has been assigned to the previous audio device, to another channel. For example, the AV receiver 3 receives from a user a setting to newly assign a rear height L (RHL) channel and a rear height R (RHR) channel to the wireless speaker 18 and the wireless speaker 19. In addition, the AV receiver 3 changes the channels that has been assigned to the wireless speaker 16 and the wireless speaker 17 from the FTR channel to a front height R (FHR) channel and from the FTL channel to a front height L (FHL) channel.

Finally, the foregoing preferred embodiments are illustrative in all points and should not be construed to limit the present invention. The scope of the present invention is defined not by the foregoing preferred embodiments but by the following claims. Further, the scope of the present invention is intended to include all modifications within the scopes of the claims and within the meanings and scopes of equivalents.

What is claimed is:

1. A content output device comprising:

at least one processor;

at least one communicator configured to output a plurality of channels from the at least one processor to a plurality of audio devices signals; and at least one memory configured to store an assignment indicating a correspondence between the plurality of audio devices and the plurality of channels, wherein:

the at least one processor configured to implement stored instructions and execute a plurality of tasks including:

a connecting task that connects the content output device with the plurality of audio devices;

an assigning task that assigns the plurality of channels to the plurality of audio devices; and an outputting task that outputs the plurality of channels to the at least one communicator for output to the plurality of audio devices in accordance with the assignment of the plurality of channels in the assigning task;

when a number of the plurality of audio devices changes, the assigning task assigns the plurality of channels to the changed number of the plurality of audio devices, and the outputting task outputs the content signal in accordance with the changed assignment of the plurality of channels;

when the number of audio devices increases and at least one channel is available to be reproduced, the assigning task assigns a channel, which has been assigned to the increased device in a past, among the at least one channel to the increased audio device in accordance with the assignment stored in the memory;

when the assigning task assigns the channel to the increased audio device, the outputting task outputs the channel in accordance with the changed assignment of the plurality of channels; and the assignment stored in the memory is set by a user.

2. The content output device according to claim 1, wherein the at least one processor is configured such that when the number of audio devices decreases, the assigning task performs processing to assign at least one channel of the plurality of channels from a one of the plurality of audio devices that is no longer connected to the content output device to a different audio device.

3. The content output device according to claim 2, wherein the at least one processor is configured such that if the one of the plurality of audio devices that is no longer connected was a center channel, the outputting task outputs a content signal of the center channel to a one of the plurality of audio devices assigned a left channel of the plurality of channels and to a one of the plurality of audio devices assigned a right channel of the plurality of channels.

4. The content output device according to claim 2, wherein the at least one processor is configured such that if the one of the plurality of audio devices that is no longer connected was a surround channel, the outputting task performs virtual sound image localization processing of the surround channel and outputs a virtual sound image of the surround channel to a one of the plurality of audio devices assigned to a front channel of the plurality of channels.

5. The content output device according to claim 1, wherein the at least one processor is configured such that when the number of audio devices increases the assigning task reassigns at least one of the plurality of channels previously assigned to a previous one of the plurality of audio devices, to a different one of the plurality of audio devices.

6. The content output device according to claim 1, wherein the plurality of tasks includes a detecting task that detects that the number of the plurality of audio devices has changed.

7. An audio system comprising:

a plurality of audio devices; and a content output device having at least one memory configured to store an assignment indicating a correspondence between the plurality of audio devices and a plurality of channels, and at least one processor configured to implement stored instructions and execute a plurality of tasks including:

a connecting task that connects a plurality of audio devices;

an outputting task that outputs a content signal of a plurality of channels to the plurality of audio devices through the connecting task; and an assigning task that, in a case in which a number of the plurality of audio devices has been changed, assigns the plurality of channels to the plurality of audio devices, based on a number of audio devices that are connected at present, a channel to be outputted, and a channel corresponding to an audio device that has been changed, wherein when the number of audio devices increases and at least one channel is available to be reproduced, the assigning task assigns a channel, which has been assigned to the increased device in a past, among the at least one channel to the increased audio device in accordance with the assignment stored in the memory;

when the assigning task assigns the channel to the increased audio device, the outputting task outputs the channel in accordance with the changed assignment of the plurality of channels; and the assignment stored in the memory is set by a user.

8. The audio system according to claim 7, wherein the plurality of audio devices includes a wireless speaker to be connected to the content output device through wireless communication.

9. A content output method comprising the acts of:

connecting a content output device to a plurality of audio devices;

storing in at least one memory an assignment indicating a correspondence between the plurality of audio devices and the plurality of channels;

assigning a plurality of channels to the plurality of audio devices;

outputting the plurality of channels to the plurality of audio devices; and when a number of the plurality of audio devices changes, reassigning the plurality of channels to the changed number of the plurality of audio devices, wherein when the number of audio devices increases and at least one channel is available to be reproduced, the act of reassigning the plurality of channels includes assigning a channel, which has been assigned to the increased device in a past, among the at least one channel to the increased audio device in accordance with the assignment stored in the memory and outputting the channel in accordance with the changed assignment of the plurality of channels; and the assignment in the memory is set by a user.

10. The content output method according to claim 9, the act of reassigning the plurality of channels includes assigning at least one channel of the plurality of channels from a one of the plurality of audio devices that is no longer connected to the content output device to a different audio device.

11. The content output method according to claim 10, wherein if the one of the plurality of audio devices that is no longer connected was a center channel outputting the center channel to a one of the plurality of audio devices assigned a left channel of the plurality of channels and to a one of the plurality of audio devices assigned a right channel of the plurality of channels.

12. The content output method according to claim 10, wherein if the one of the plurality of audio devices that is no longer connected was a surround channel performing, virtual sound image localization processing of the surround channel and outputting virtual sound image of the surround channel to a one of the plurality of audio devices assigned to a front channel of the plurality of channels.

13. The content output method according to claim 9, wherein when the number of audio devices increases, the reassigning act includes reassigning at least one of the plurality of channels previously assigned to a previous one of the plurality of audio devices to a different one of the plurality of audio devices.

14. The content output method according to claim 9, further comprising the act of:

detecting that the number of the plurality of audio devices has changed.

* * * * *